US008176637B2

(12) United States Patent
Fukutani et al.

(10) Patent No.: US 8,176,637 B2
(45) Date of Patent: May 15, 2012

(54) HAIR CLIPPER

(75) Inventors: Makoto Fukutani, Hikone (JP); Toshio Ikuta, Hikone (JP); Jiro Inaba, Nagahama (JP)

(73) Assignee: Panasonic Corporation, Osaka (JP)

( * ) Notice: Subject to any disclaimer, the term of this patent is extended or adjusted under 35 U.S.C. 154(b) by 50 days.

(21) Appl. No.: 11/466,182

(22) Filed: Aug. 22, 2006

(65) Prior Publication Data

US 2007/0044320 A1 Mar. 1, 2007

(30) Foreign Application Priority Data

Aug. 26, 2005 (JP) ..... 2005-246797

(51) Int. Cl.
*B26B 19/00* (2006.01)

(52) U.S. Cl. ..... 30/201; 30/43.91; 30/43.92; 30/200; 30/225

(58) Field of Classification Search ..... 30/43.91, 30/43.92, 200, 225, 201
See application file for complete search history.

(56) References Cited

U.S. PATENT DOCUMENTS

| | | | | |
|---|---|---|---|---|
| 2,262,389 | A * | 11/1941 | Dalkowitz | 30/43.92 |
| 2,292,364 | A * | 8/1942 | Cromonic | 30/201 |
| 2,481,097 | A * | 9/1949 | Fewins | 30/200 |
| 2,558,459 | A * | 6/1951 | Podner | 30/220 |
| 3,430,342 | A | 3/1969 | Wahl | |
| 4,152,830 | A * | 5/1979 | Meijer et al. | 30/195 |
| 4,825,546 | A | 5/1989 | Araki et al. | |
| 5,367,772 | A | 11/1994 | Ogawa | |
| 5,600,890 | A | 2/1997 | Leitner et al. | |
| 6,973,855 | B2 * | 12/2005 | Yanosaka et al. | 76/101.1 |
| 2003/0145469 | A1 | 8/2003 | Ogawa et al. | |

FOREIGN PATENT DOCUMENTS

| | | |
|---|---|---|
| EP | 1354674 | 10/2003 |
| JP | 50-155353 | 12/1975 |
| JP | 63-054187 | 3/1988 |
| JP | 5-317537 | 12/1993 |
| JP | 05-317537 | 12/1993 |
| JP | 11-197372 | 7/1999 |
| JP | 2001-096081 | 4/2001 |
| KR | 200344679 | 3/2004 |

OTHER PUBLICATIONS

English Language Abstract of JP 2001-096081.
English Language Abstract of JP 5-317537.
English Language Abstract of KR 20-0344679.
English language abstract and translation of JP 2001-096081.
English Language Abstract JP2001-096081.
English Language Abstract JP5-917537.
Japan Office action, dated Mar. 15, 2011 along with an english translation thereof.

* cited by examiner

*Primary Examiner* — Robert Scruggs
(74) *Attorney, Agent, or Firm* — Greenblum & Bernstein P.L.C.

(57) ABSTRACT

The hair clipper comprises comb-like fixed blade and movable blade each having a plurality of comb-teeth each provided at its both sides with blades, in which the movable blade is reciprocated with respect to the fixed blade in an arrangement direction of the comb-teeth to cut hair, the fixed blade or the movable blade is slid in a projecting direction of the comb-teeth to adjust cutting height, wherein a tip of each comb-tooth of the fixed blade is provided with a guide projection for introducing hair, the guide projection is tapered with an inclination angle which is larger than an inclination angle of the comb-tooth with respect to projecting direction of blades on both sides of the comb-tooth.

5 Claims, 9 Drawing Sheets

HAIR CLIPPER

CROSS REFERENCE TO RELATED APPLICATION

This application is based upon and claims the benefit of priority from prior Japanese Patent-Application P2005-246797, filed on Aug. 26, 2005; the entire contents of which are incorporated by reference herein.

BACKGROUND OF THE INVENTION

1. Field of the Invention

The present invention relates to a hair clipper for cutting hair by reciprocating a movable blade with respect to a fixed blade.

2. Description of the Related Art

Conventionally, there is a known hair clipper comprising comb-like fixed blade and movable blade having a plurality of comb-teeth provided at their both sides with blades. This hair clipper is used for cutting hair by reciprocating the movable blade with respect to the fixed blade in an arrangement direction of the comb-teeth. The cutting height can be adjusted by sliding the movable blade with respect to the fixed blade in a projecting direction of the comb-teeth (see Japanese Patent Application Laid-open No. H5-317537).

FIGS. 1A and 1B show a fixed blade 50 of a conventional hair clipper. A plurality of comb-teeth 51 are arranged in parallel on the fixed blade 50. Bach comb-tooth 51 is tapered having small inclination angle α on both side of the comb-tooth 51 in a projecting direction thereof. In order lo enhance efficiency in introducing hair into a blade groove 52 formed between adjacent comb-teeth 51, it is desired that the tip width of the comb-tooth 51 is equal to or smaller than 0.1 millimeter which is a general hair width. For the fixed blade 50 of a hair clipper whose cutting height can be adjusted, however, since it is necessary to largely set the projecting length of the comb-tooth 51 if the tip width of the comb-tooth 51 is reduced as small as about 0.1 millimeter, the entire comb-tooth 51 becomes thin, and there is a problem that the strength thereof cannot be secured.

In this regard, it also seems possible that the tip width of the comb-tooth 51 is set to about 0.1 millimeter, and the inclination angles α on both sides of the teeth are set larger, thereby securing the strength of each comb-tooth 51. However, if the inclination angle α is increased in this manner, since the projecting length L of the comb-tooth 51 is long, the width of the root portion of the comb-tooth 51 becomes extremely wide, and the number of teeth of the entire fixed blade 2 is reduced. As a result, there is a problem that chances for cutting hair are reduced or hairs easily escape from the blade groove 52.

That is, in the case of the hair clipper in which the projecting length L of the comb-tooth 51 of the fixed blade 50 is set long in order to adjust the cutting height, there is a problem that it is difficult to achieve the following three points at the same time, i.e., to enhance the introducing degree of hair between the comb-teeth 51, to secure the strength of the fixed blade 50, and to secure the number of teeth of the fixed blade 50.

SUMMARY OF THE INVENTION

The present invention has been achieved in view of the above problems, and it is an object of the invention to provide a hair clipper capable of adjusting the cutting height, enhancing the introducing degree of hair, securing the strength of the fixed blade, and securing the number of teeth of the fixed blade at the same time.

To solve the above problem, the present invention provides a hair clipper comprising comb-like fixed blade 2 and movable blade 3 each having a plurality of comb-teeth 2*a* and 3*a* each provided at its both sides with blades 2*c* and 3*c*, in which the movable blade 3 is reciprocated with respect to the fixed blade 2 in an arrangement direction X of the comb-teeth 2*a* and 3*a* to cut hair, the fixed blade 2 or the movable blade 3 is slid in a projecting direction Y of the comb-teeth 2*a* or 3*a* to adjust cutting height, wherein a tip of each comb-tooth 2*a* of the fixed blade 2 is provided with a guide projection 21 for introducing hair, the guide projection 21 is tapered with an inclination angle β which is larger than an inclination angle α of the comb-tooth 2*a* with respect to projecting direction Y of blades 2*c* on both sides of the comb-tooth 2*a*.

According to the hair clipper having the above structure, when hair is to be cut, hair which hits on the guide projection 21 of the fixed blade 2 slips on both tapered surfaces of the inclination angle β of the guide projection 21, and the hair is efficiently introduced between the adjacent comb-teeth 2*a* without falling. Further, the comb-teeth 2*a* of inclination angle α can keep sufficient width from its root to its tip and thus, the strength can be secured although the projecting length for adjusting the cutting height is long. In addition, since the inclination angle α of the comb-teeth 2*a* itself is small, the root width of the comb-teeth 2*a* does not become excessively wide, and the number of teeth is secured.

It is preferable that the tip width of the guide projection 21 is equal to or smaller than a width of hair. As a result, the efficiency in introducing hair is further enhanced.

BRIEF DESCRIPTION OF THE DRAWINGS

FIGS. 1A and 1B show a fixed blade of a conventional hair clipper, wherein FIG. 1A is a front view and FIG. 1B is an enlarged view of a C portion in FIG. 1A;

FIGS. 2A and 23 show a fixed blade of a hair clipper which is one example of an embodiment of the present invention, wherein FIG. 2A is a front view and FIG. 23 is an enlarged view of a D portion in FIG. 2A;

FIGS. 3A and 3B show the fixed blade of the hair clipper, wherein FIG. 3A is a sectional view taken along the line I-I in FIG. 2A, and FIG. 33 is an enlarged view or an E portion in FIG. 3A;

FIGS. 4A and 4B show the entire hair clipper, wherein FIG. 4A is a side view and FIG. 4B is a front view;

FIGS. 8A and 8B show a case wherein a cutting height of the blade block is set small, wherein FIG. 8A is a front view and FIG. 8B is a side view; and FIGS. 9A and 9B show a case where the cutting height of the blade block is set large, wherein FIG. 9A is a front view and FIG. 9B is a side view.

DETAILED DESCRIPTION OF THE PREFERRED EMBODIMENTS

Figure 4A:
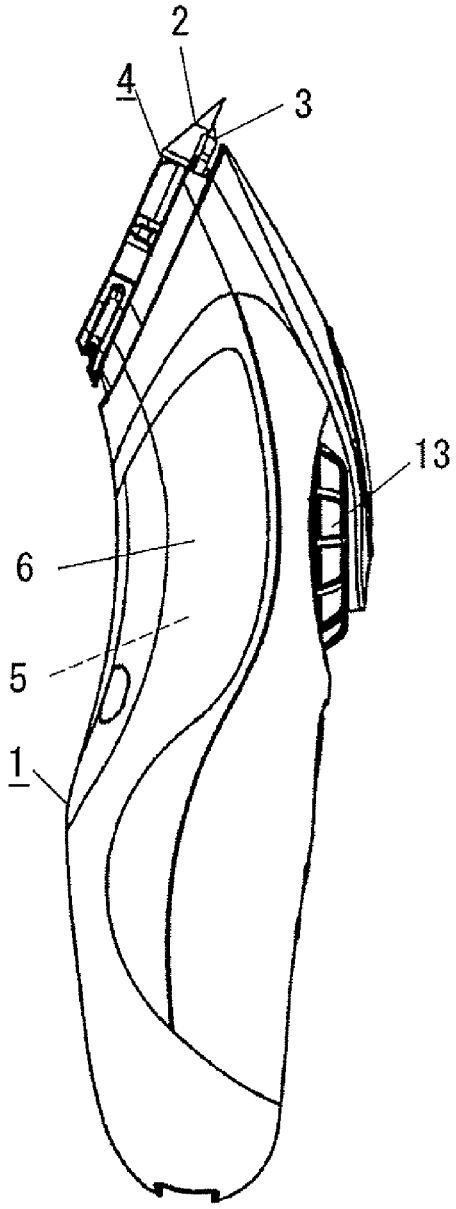
Figure 4B:
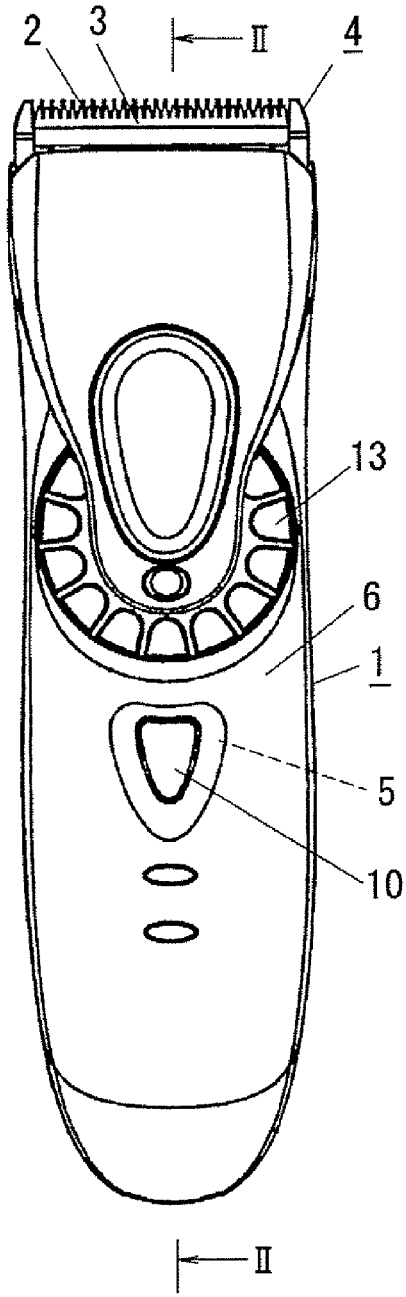

Embodiments of the present invention will be explained below with reference to the drawings. One example of a hair clipper according to an embodiment of the present invention has a thin and long main body 1 which also functions as a grip as shown in FIGS. 4A and 4B. A blade block 4 having a fixed blade 2 and a movable blade 3 is mounted on the top the main body 1 in its longitudinal direction (upper end in FIGS. 4A and 4B) The movable blade 3 of the blade block 4 is reciprocated while sliding in the lateral direction (in FIG. 4B) with respect to the fixed blade 2 by a motor disposed in the main body 1 as a driving source, so that hair introduced into the blade grooves 2*b* on the tip of the fixed blade 2 is hold between the movable blade 3 and cut.

Figure 5:
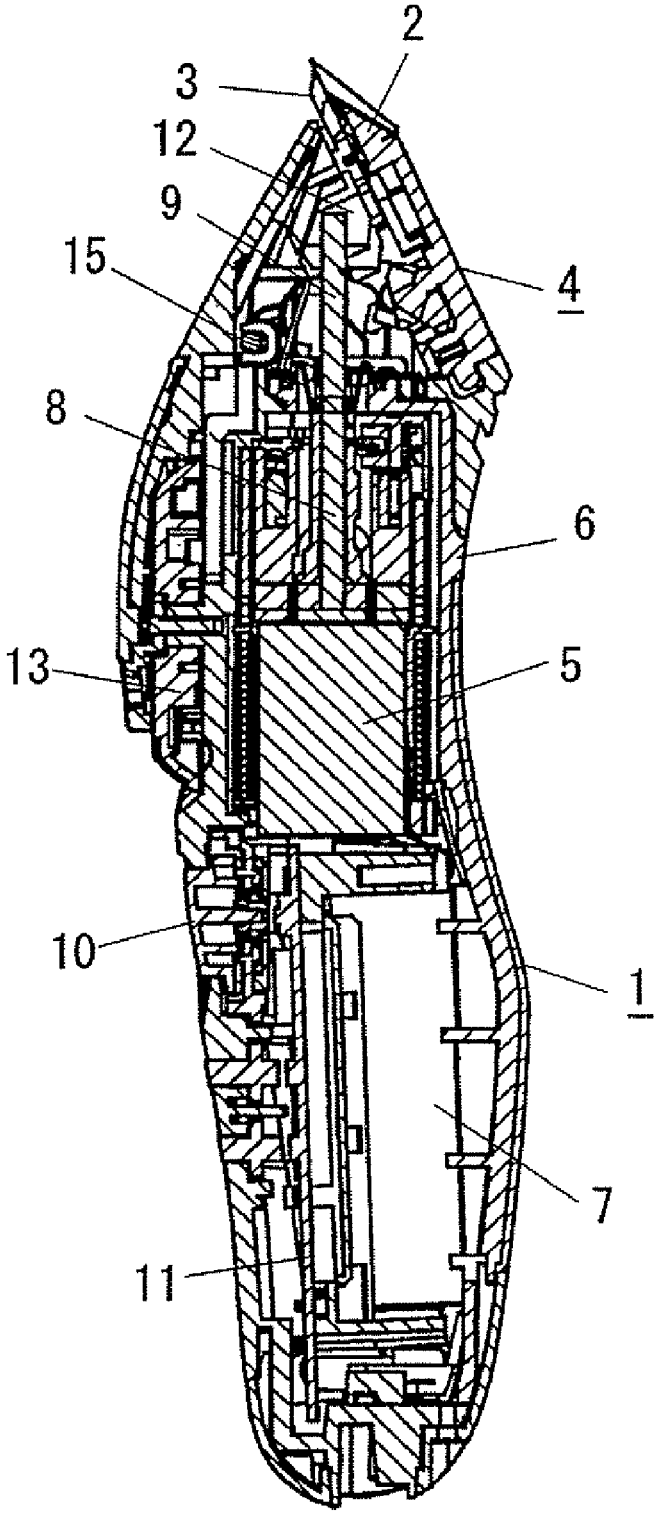
FIG. 5 is a sectional view taken along the line II-II in FIG. 4B.

As shown in FIG. 5, the main body 1 has a main body housing 6 forming a substantially S-shaped outer envelope as viewed from side. A user can grasp the main body housing 6 with his or her one hand. Accommodated in the man body housing 6 are a rechargeable battery 7, a motor 5 to which electricity is supplied from the rechargeable battery 7 to be is rotated, a power transmitting mechanism 8 for transmitting a rotation driving force of the motor 5 toward an upper end in the drawing, an eccentric shaft 9 which is rotated by the power transmitting mechanism 8 in an eccentric manner, and a controller 11 which controls electricity supply to the motor 5 in accordance with pushing operation of an operating switch 10 which is exposed outside. The eccentric shaft 9 projects upward in the drawing from the main body housing 6 such that the eccentric shaft 9 is connected to a later-described guide plate 17 provided on the blade block 4. A dial 13 for adjusting the cutting height is turnably disposed on an upper portion (in the drawing) of the operating switch 10 on an outer surface of the main body housing 6. A transmitting mechanism 15 is provided in the main body housing 6. The transmitting mechanism 15 tilts a later-described switch lever 19 of the blade block 4 in association with normal or reverse rotation of the dial 13.

Figure 6:
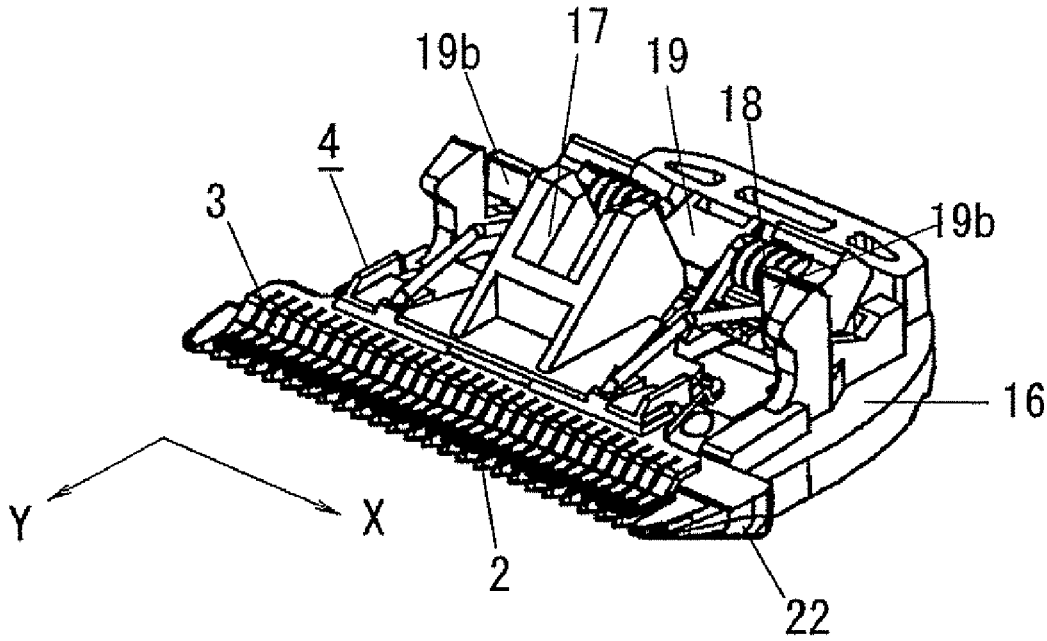
FIG. 6 is a perspective view of an entire blade block of the hair clipper.
Figure 7:
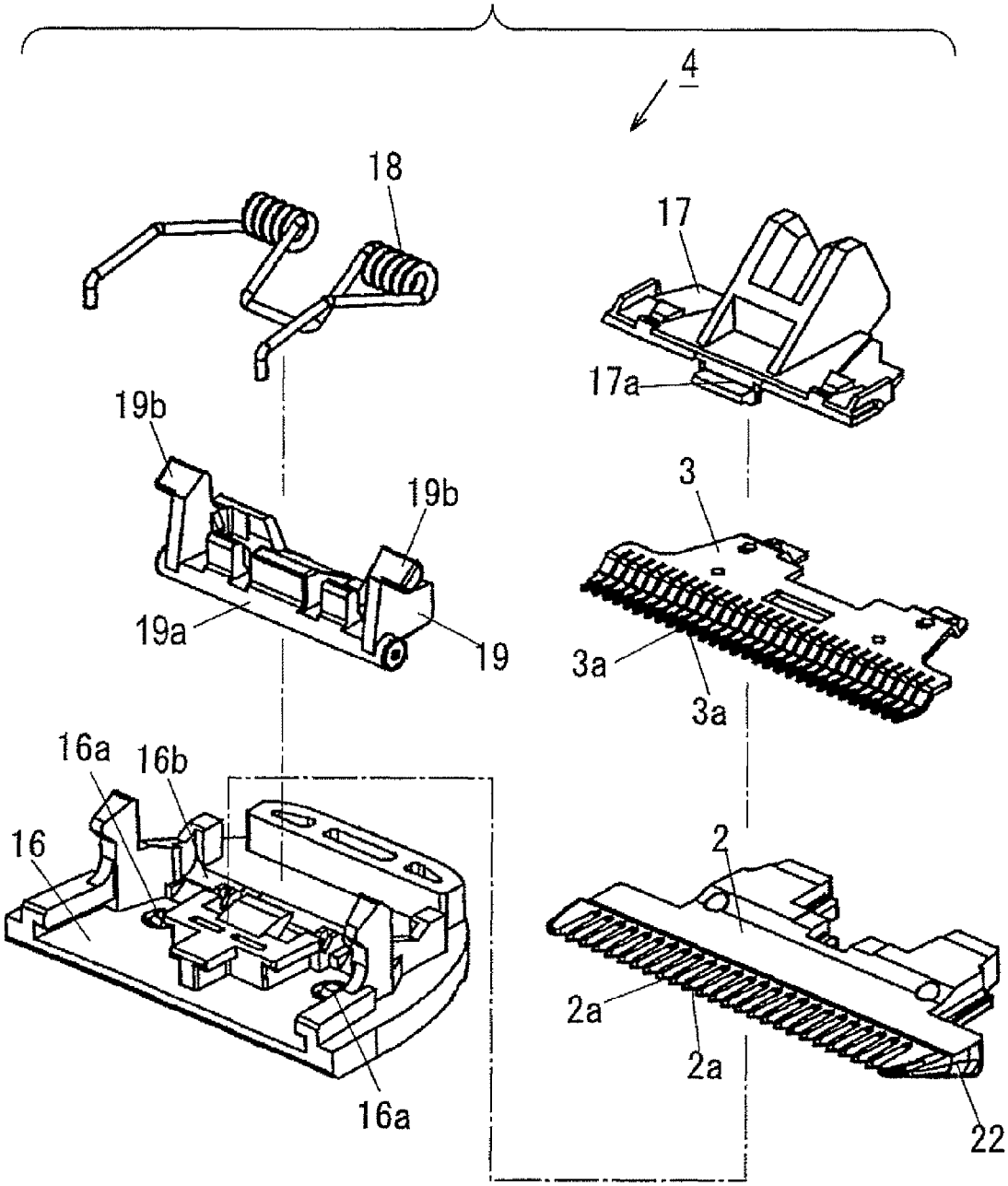
FIG. 7 is an exploded perspective view of the blade block.

FIG. 6 is a perspective view of the entire blade block 4. FIG. 7 is an exploded perspective view of the blade block 4. The blade block 4 includes the comb-like fixed blade 2 comprising a plurality of tapered comb-teeth 2*a* each provided at its both sides with blades 2*c*, the comb-like movable blade 3 having a plurality of tapered comb-teeth 3*a* each provided at its both sides with blades 3*c*, a fixing plate 16 which has a hook 16*a* to be engaged with the fixed blade 2 and which fixes the fixed blade 2 by the hook 16*a*, a guide plate 17 which has a hook 17*a* to be engaged with the movable blade 3 and which fixes the movable blade 3 by the hook 17*a* and a heat seal, a coil-shaped push-up spring 18 disposed between the fixing plate 16 and the guide plate 17 in a resiliently deformed state which gives a biasing force for pushing the movable blade 3 against the fixed blade 2, and a switch lever 19 which has a columnar portion 19*a* pivotally supported by a semi-circular groove 16*b* formed in the fixing plate 16, which is disposed on the fixing plate 16 such that the switch lever 19 can tilt around the columnar portion 19*a*, and which is biased toward its tilting attitude by the push-up spring 18 when the coil portion of the push-up spring 18 is fitted and disposed if the switch lever 19 is turned toward its standing attitude against the biasing force of the push-up spring 18, the movable blade 3 slides toward the projection direction of comb-teeth 2*a* and 3*a* while holding a pressing state against the fixed blade 2 (hereinafter, "projecting direction Y") via the push-up spring 18 and the guide plate 17.

Figure 8A:
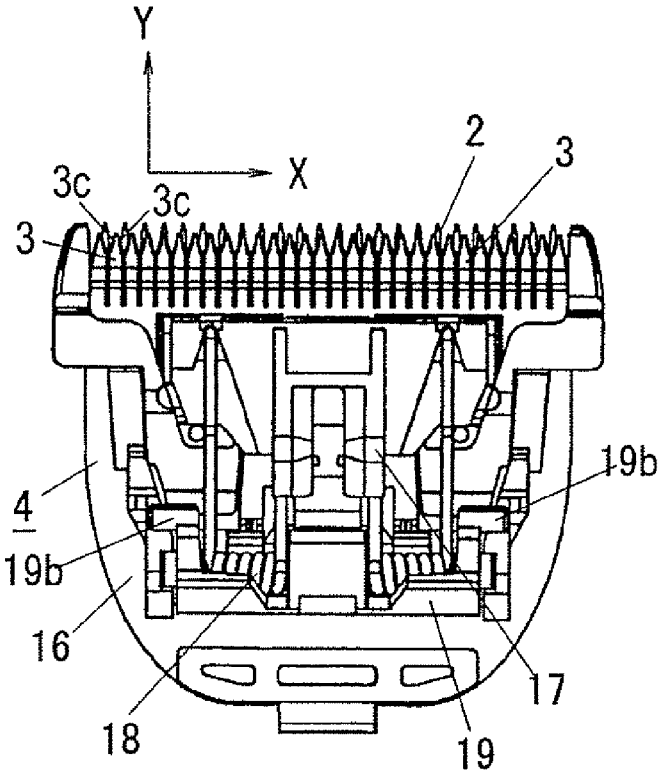
Figure 8B:
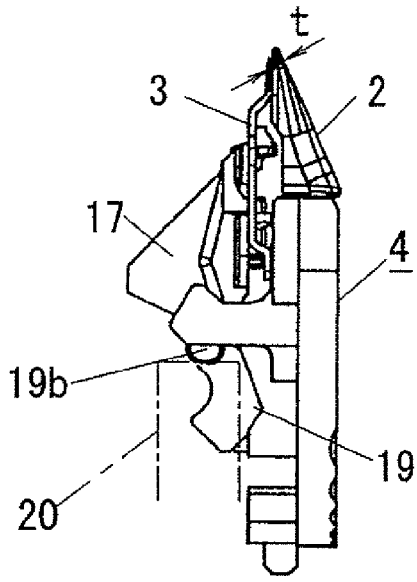
Figure 9A:
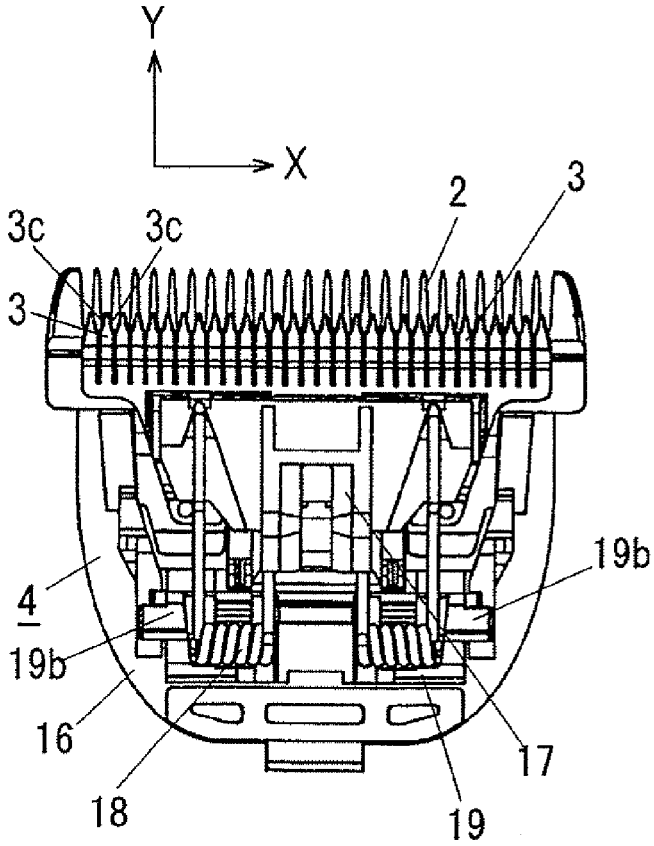
Figure 9B:
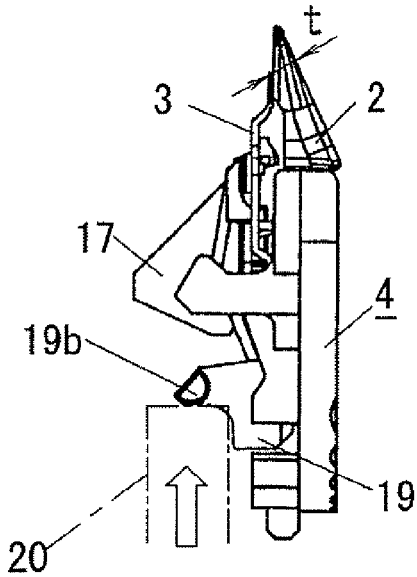

The tilting operation of the switch lever 19 is carried out so that an operation member 20 (see FIGS. 8B, 9B) provided on the transmitting mechanism 15 pushes protections 19*b* provided on the switch lever 19 in the direction of arrow in FIG. 9B. That is, if the rotation position of the dial 13 is moved in a predetermined positive direction, the switch lever 19 is turned toward its standing attitude through the transmitting mechanism 15 against the biasing force of the push-up spring 18. As a result, the movable blade 3 slides such that tips of the comb-teeth 3*a* approach the tips of the comb-teeth 2*a* of the fixed blade 2. If the rotation position of the dial 13 is moved in the opposite direction, the switch lever 19 turns toward its laying attitude by the biasing force of the push-up spring 18, and the movable blade 3 slides such that the tips of the comb-teeth 3*a* are separated away from the tips of the comb-teeth 2*a* of the fixed blade 2.

Each comb-tooth 2*a* of the fixed blade 2 is tapered as viewed from side such that its thickness t is varied along the projecting direction Y. Therefore, by changing the slide position of the movable blade 3 with respect to the fixed blade 2, the cutting height of hair can be adjusted. The above-described cutting height adjusting mechanism is merely one example, and any known cutting height adjusting mechanisms can be used only if the movable blade 3 can be slid in the projecting direction Y with respect to the fixed blade 2 in accordance with a user's operation.

Figure 1A:
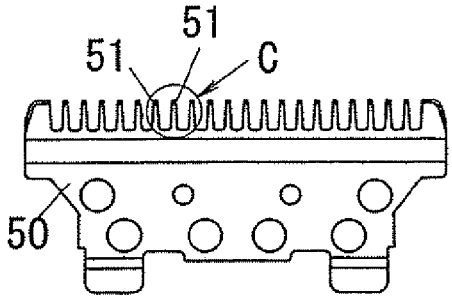
FIG. 1A RELATED ART
Figure 1B:
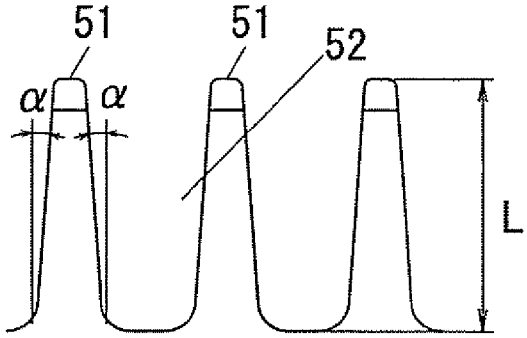
FIG. 1B RELATED ART
Figure 2A:
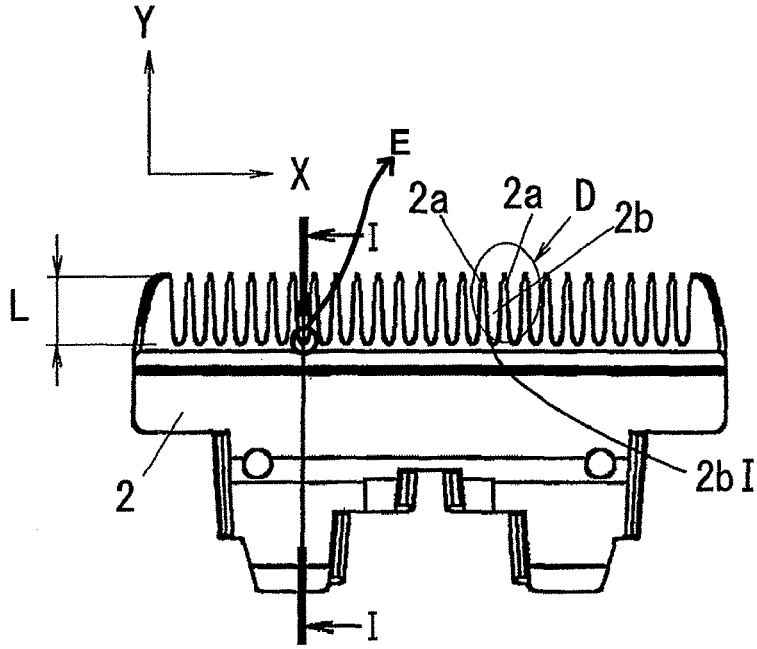
Figure 2B:
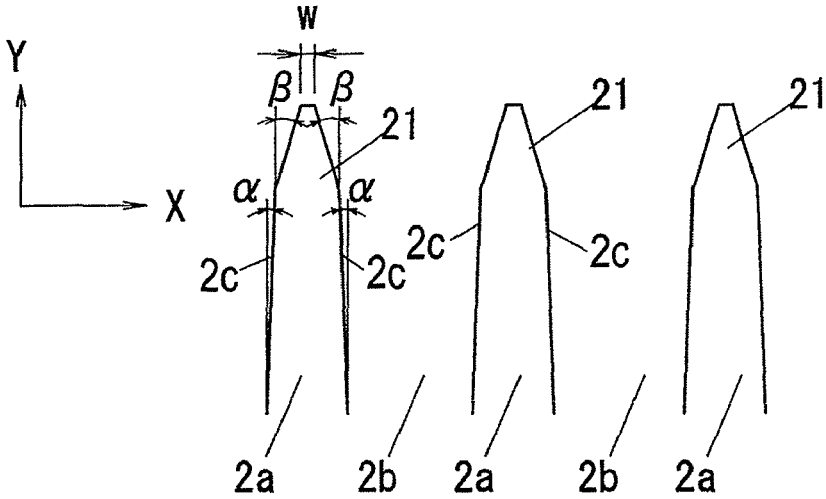

In this example, in order to enhance the efficiency in introducing hair into the blade groove 2*b* formed between adjacent comb-teeth 2*a* of the fixed blade 2 while securing strength of the fixed blade 2 of the hairclipper whose cutting height can be adjusted, and in order to secure the number of teeth of the fixed blade 2, each comb-tooth 2*a* of the fixed blade 2 is provided with a guide projection 21 as shown in FIG. 2B.

Moreover, as shown in FIG. 2A, a bottom edge 2*b*I of the blade groove 2*b* is formed between the adjacent comb-teeth 2*a*, 2*a*.

Each guide projection 21 is a portion for guiding hair formed on the tip portion of each comb-tooth 2*a* of the fixed blade 2 projecting toward the tip of the comb-tooth 2*a* than the comb-teeth 3*a* of the movable blade 3. The guide projection 21 is tapered with an inclination angle β which is greater than the inclination angle α of the blade 2*c* on each of both sides of the comb-tooth 2*a* of the fixed blade 2 with respect to the projecting direction Y. The guide projection 21 has an apical surface which is substantially flat. The inclination angle α is in a range of 0 to 10° so that the widths of the entire comb-teeth 2 are uniform or slightly reduced from their roots toward their tips. The inclination angle β is in a range of 10 to 20° so that the width of the guide projection 21 is abruptly reduced. The guide projection 21 is provided with the apical surface whose width W becomes 0.1 millimeter.

Therefore, when hair is to be cut, hair which hits on the guide projection 21 of the fixed blade 2 slips on both tapered surface of the inclination angle β of the guide projection 21 and is introduced into the blade groove 2*b* with high efficiency without falling. In order to make it possible to adjust the cutting height, the inclination angle α of the comb-teeth 2*a* of the fixed blade 2 is small whereas the projecting length is set large. Therefore, the width thereof is about 0.3 millimeter from the root to the tip and strength is secured. In addition, since the inclination angle α is small, the root width of the comb-tooth 2*a* is not excessively wide, the number of blade grooves 2*b* is secured, and it is possible to prevent hair from escaping from the blade groove 2*b*.

Although the apical surface width W of the guide projection 21 is set to 0.1 millimeter that is almost equal to a hair width as described above so as to enhance the efficiency in introducing hair, this width W can be equal to or smaller than 0.1 millimeter.

Smooth convex curved surfaces 22 are formed on both side ends of the fixed blade 2 in a direction in which the comb-teeth 2*a* are arranged (hereinafter, "arrangement-direction X") substantially over its entire surface except a surface facing the movable blade 3 (see FIGS. 6 and 7). Each convex curved surface 22 has large radius of curvature. The convex curved surface 22 is convex in shape such that its thickness become smaller toward the end in the arrangement direction X, and the convex curved surface 22 is continuously formed from the root toward the tip of the blade in the projecting direction Y. The slipping degree between the fixed blade 2 and a skin especially when the hair clipper is used while inclining the blade block 4 to cut hair around an ear is excellent.

Figure 3A:
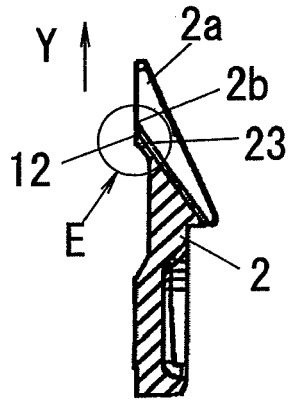
Figure 3B:
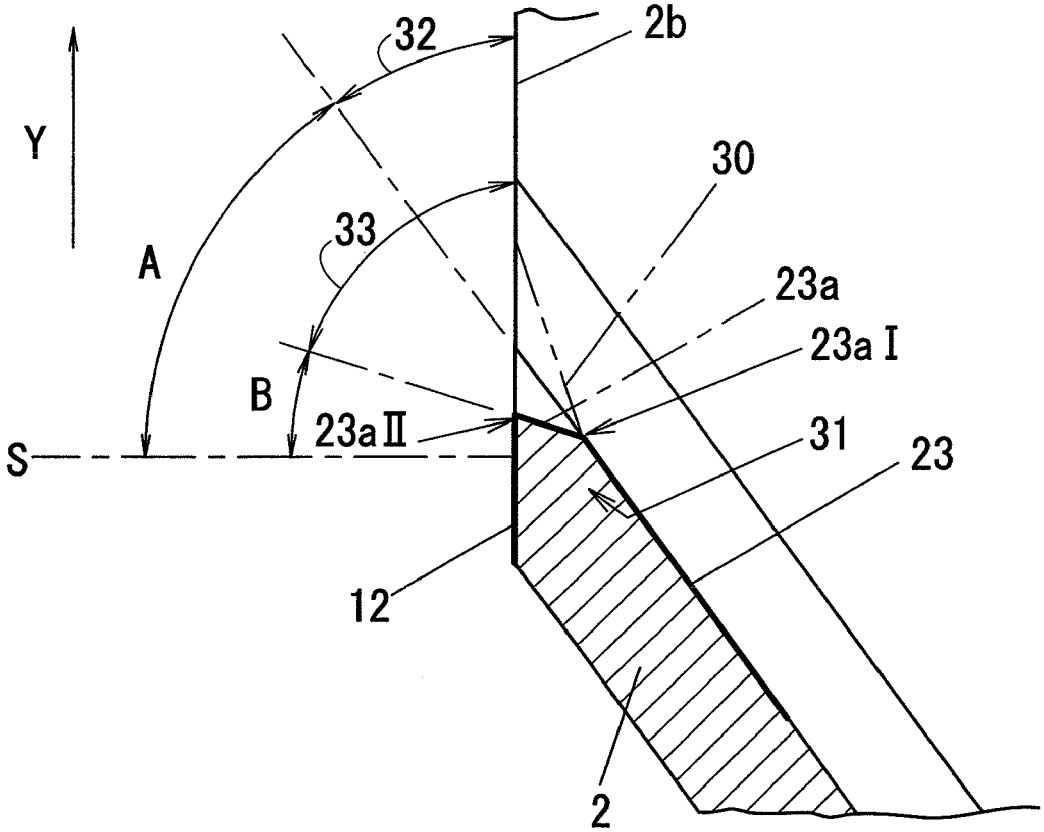

As shown in FIGS. 3A and 3B, the fixed blade 2 is formed with an inclined surface 23 which extends from a bottom edge of the blade groove 2*b* so that the inclined surface 23 functions as a comb for combing cut hair or not-cut hair. The inclined surface 23 is inclined with respect to a plane S perpendicular to the projecting direction Y by an angle A. When the inclined surface 23 is formed only by the angle A, a burr 30 shown with two-dot chain line in the drawing is adversely generated when it is made possible to polish a sliding surface 12 with respect to the movable blade 3. Thus, an inclined surface 23*a* shown with one-dotted line inclined by an angle B smaller than the angle A is formed only on a portion of the inclined surface 23 close to the blade groove 2*b* while taking this burr 30 in consideration. As a result, the amount of burr 30 to be generated is suppressed to the minimum, and it is possible to allow hair to pass through without inhibition.

To be more specific, FIG. 3B discloses an acute-angled corner 31 which is formed by an inclined surface 23 (i.e., first side), an inclined surface 23*a* (i.e., second side) and a sliding surface 12 (i.e., third side). Moreover, FIG. 3B discloses a first end 23*a*I (of the inclined surface 23*a*), a second end 23*a*II (of the inclined surface 23*a*), a first angle 32 and a second angle 33. As illustrated in FIG. 3B, the first end 23*a*I of the inclined surface 23*a* intersects the inclined surface 23 and the second end 23*a*II of the inclined surface 23*a* intersects the sliding surface 12. Further, as illustrated in FIG. 3B, the inclined surface 23 defines a straight line that intersects the first end 23*a*I of the inclined surface 23*a*.

The fixed blade 2 is produced by metal powder injection molding (MIM). Therefore, the shape of each portion of the fixed blade 2 can be formed freely, and since post-machining is unnecessary, cost can be reduced.

According to the present invention, it is possible to adjust the cutting height, enhance the efficiency in introducing hair, secure the strength of the fixed blade, and secure the number of teeth of the fixed blade.

While the embodiment of the present invention has been described above, the invention is not limited to the above embodiment and changes and modifications can be made within the scope of the gist of the present invention.

What is claimed is:

1. A hair clipper comprising:

a comb-like fixed blade and a movable blade, each having a plurality of comb-teeth and each provided at its both sides with blades, in which the movable blade is reciprocated with respect to the fixed blade in an arrangement direction of the comb-teeth to cut hair, a fixing plate having a hook engaged with the fixed blade, a guide plate having a hook engaged with the movable blade, and a switch lever having a columnar portion pivotally supported by the fixing plate such that the switch lever is rotatable around the columnar portion, so that when the switch lever is rotated around the columnar portion, the fixed blade or the movable blade slides in a projecting direction of the comb-teeth to adjust cutting height, wherein a tip of each comb-tooth of the fixed blade is provided with a guide projection for introducing hair, the guide projection is tapered with an inclination angle which is larger than an inclination angle of the blades on both sides of the comb-tooth of the fixed blade with respect to the projecting direction, a cross section of the fixed blade taken, perpendicular to the arrangement direction of the comb teeth, at a bottom edge of a blade groove formed between adjacent comb-teeth and extending rearward of the comb teeth has an acute-angled corner at an end in the projecting direction, the acute-angled corner is formed by:

a first side which is inclined with respect to the projecting direction at a first angle, a second side adjacent to the first side, which is inclined with respect to the projecting direction by a second angle that is larger than the first angle, a third side adjacent to the second side, which is parallel to the projecting direction, and a first end of the second side intersects the first side and a second end of the second side intersects the third side.

2. The hair clipper according to claim 1, wherein the tip width of the guide projection is formed to be equal to or smaller than a width of hair.

3. The hair clipper according to claim 1, wherein the bottom edge of the blade groove extends linearly.

4. The hair clipper according to claim 1, wherein the first and second angles are acute angles.

5. The hair clipper according to claim 1, wherein the second side is positioned forward of the first side in the projecting direction.

* * * * *